United States Patent [19]

Pfister et al.

[11] Patent Number: 4,932,580

[45] Date of Patent: Jun. 12, 1990

[54] EXPLOSIVE POWDER CHARGE OPERATED SETTING DEVICE

[75] Inventors: Norbert Pfister, Buchs; Leo Philipp, Untervaz, both of Switzerland

[73] Assignee: Hilti Aktiengesellschaft, Fűrstentum Liechtenstein

[21] Appl. No.: 317,856

[22] Filed: Mar. 2, 1989

[30] Foreign Application Priority Data

Mar. 2, 1988 [DE] Fed. Rep. of Germany ..... 3806625

[51] Int. Cl.[5] ..... B25C 1/14

[52] U.S. Cl. ..... 227/10; 227/120; 227/136

[58] Field of Search ..... 227/10, 119, 120, 121, 227/125, 126, 135, 136, 137, 127, 128, 93

[56] References Cited

U.S. PATENT DOCUMENTS

| | | | |
|---|---|---|---|
| 3,506,178 | 4/1970 | Brunelle | 227/10 |
| 3,670,942 | 6/1972 | Pomeroy | 227/10 |
| 3,826,419 | 7/1974 | Maestri | 227/136 |
| 3,920,169 | 11/1975 | DeCaro | 227/120 X |
| 4,610,381 | 9/1986 | Kramer et al. | 227/120 X |

FOREIGN PATENT DOCUMENTS 2314920 8/1978 Fed. Rep. of Germany .

*Primary Examiner*—Frank T. Yost
*Assistant Examiner*—Rinaldi Rada
*Attorney, Agent, or Firm*—Toren, McGeady & Associates

[57] ABSTRACT

An explosive powder charge operated setting device includes an axially extending barrel with a guide magazine for a nail strip extending transversely of the barrel axis. A spring member within the magazine biases individual nails in the strip into the barrel bore. The magazine is aligned with a first aperture opening through the barrel into the bore. Diametrically opposite the first aperture is a second aperture so that a nail strip can be introduced through the second aperture, the barrel, and the first aperture, into the magazine. A stop is displaceably mounted on the barrel and can be held in a first position in the second aperture for holding nails in the strip in axial alignment with the barrel bore axis.

3 Claims, 1 Drawing Sheet

EXPLOSIVE POWDER CHARGE OPERATED SETTING DEVICE

BACKGROUND OF THE INVENTION

The present invention is directed to an explosive charge operated setting device with an axially extending barrel and a guide magazine extending transversely of the barrel for holding a nail strip. The nail strip within the magazine is spring biased for inserting individual nails held in the strip into the barrel bore through an aperture in one side of the barrel.

An explosive charge operated setting device is disclosed in DE-PS No. 23 14 920 where a nail strip, made up of a carrier and nails supported in the carrier, is fed into the barrel bore through a feed aperture located near the muzzle of the barrel. The nail strip is displaceably supported in the magazine which extends transversely from the barrel and is biased by a spring and a slide for feeding nails into the barrel bore. Each nail fed into the barrel bore is separated from the strip by a driving piston displaceably supported in the barrel bore for driving the nails into a receiving material.

The spring and the slide must be moved out of the guide magazine for introducing a new nail strip into the magazine or for removing a partially used strip from the magazine and results in cumbersome handling operations.

SUMMARY OF THE INVENTION

Therefore, the primary object of the present invention is to provide a setting device of the type mentioned above which permits charging and removing nail strips in simple operations.

In accordance with the present invention, a charging aperture in alignment with the guidance path in the magazine is provided in the barrel diametrically opposite an insertion aperture so that a nail strip can be introduced into the magazine. A stop is pivotally mounted on the barrel for movement into a position within the charging aperture and aligned with the surface of the barrel bore.

If the stop is displaced out of the charging aperture, a nail strip can be inserted, in turn, through the charging aperture, the barrel bore, and the insertion aperture into the guide magazine with the introduction of the nail strip taking place against the force of the spring in the magazine. Similarly, in an opposite manner, a nail strip can be removed from the magazine when the stop is displaced out of the charging aperture. As a result, the spring effects an automatic ejection of the nail strip. After the nail strip is completely inserted, the stop is moved into the charging aperture and retains the nail strip in place against the force of the spring maintaining the nail contacted by the stop in position within the barrel bore aligned with the bore axis so that it can be driven into the receiving material. This setting device is suitable for nail strips made up of individual holders, each containing one nail with the holder being severed from the remainder of the nail strip by the driving piston when the piston propels the nail into a receiving material. It is also possible to use nail strips where the nails ar displaced out of the individual holders.

An abutment can be provided on the barrel for supporting the stop in its position within the charging aperture holding individual nails in position to be driven. By means of the abutment, the position of the stop within the charging aperture is retained with the abutment formed as a wall part of the barrel.

Preferably, the stop is formed as part of a rocking lever mounted on the barrel. Such an arrangement of the stop affords a compact construction in the region of the setting device where the lever is mounted along the axial direction of the barrel.

In a preferred arrangement, the locking lever is provided with two arms with one arm forming the stop and the other arm providing a shoulder acting on the abutment. Accordingly, the rocking lever performs a double function, that is, in a first position the stop is located as a part of the contour of the barrel bore surface with the support shoulder bearing on the abutment and in another pivoted second position, the support shoulder is remote from the abutment and the stop is located outside of the charging aperture. From the second position, the stop can be moved into the barrel bore by pivoting the rocking into moving out of the charging aperture.

Preferably, the spring means are provided on the rocking lever for biasing it into position in the charging aperture. The spring means permit the stop on the lever to be pivoted against the spring force in the magazine out of the charging aperture so that a nail strip can be introduced into the magazine through the charging aperture. After the nail strip has been completely introduced, the rocking lever can be released with the spring returning the stop into the charging aperture. The spring means retains the rocking lever with the stop in the charging aperture due to the cooperation of the support shoulder with the abutment on the barrel.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
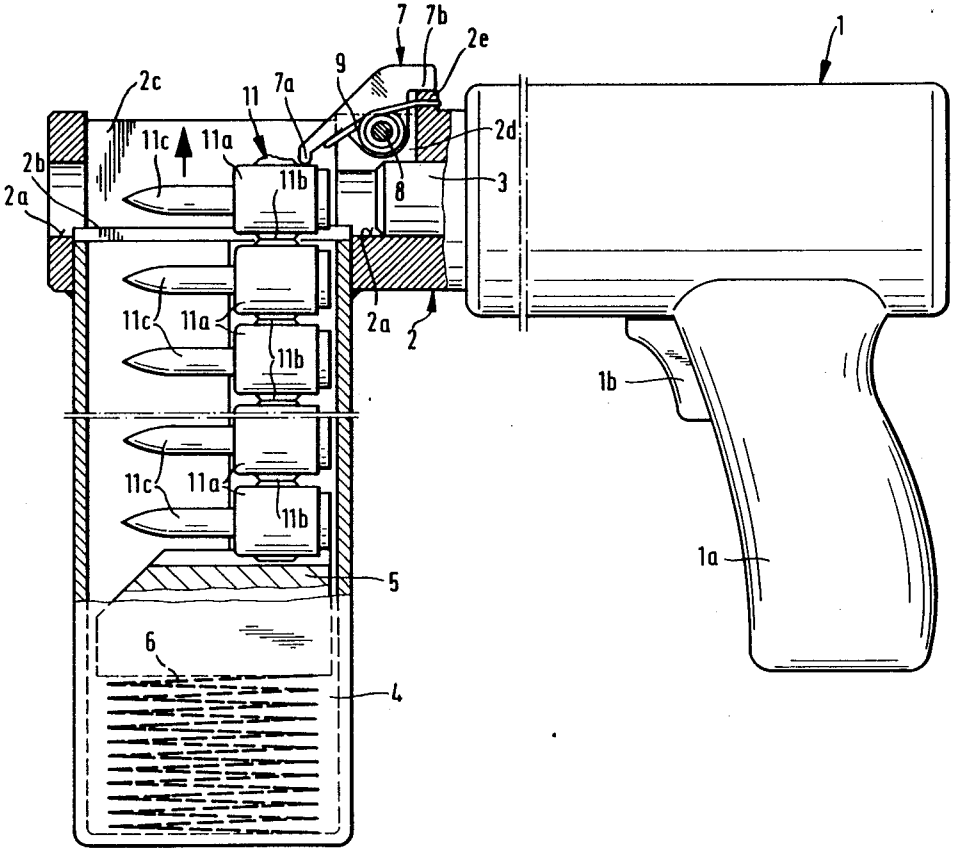
FIG. 1 is a side elevational view, partly in section, of a setting device with a nail strip inserted into the magazine.

In FIG. 1, the setting device includes a housing 1 with a handle 1*a* at one end with a trigger 1*b* mounted in the handle. A barrel 2, with an axially extending barrel bore 2*a*, extends out of the opposite end of the housing from the handle 1*a*. A driving piston 3, shown in its rear position, is supported in the barrel bore 2*a*. Driving piston 3, can be driven toward the muzzle of the barrel, that is, the lower end as viewed in FIG. 1, by the force of an explosive powder charge in a known manner. A guide magazine 4, is securely held in the barrel 2, and extends transversely outwardly from the barrel adjacent its muzzle. The interior of the guide magazine is aligned with a first or insertion aperture 2*b*, extending through the wall of the barrel 2 into its bore 2*a*. A slide 5 is located in the guide magazine and is biased by a spring 6, toward the barrel bore 2*a*. As can be seen in FIG. 1, the spring bears against the slide 5 at one end and against the end wall of the magazine 4 at its other end.

Within the barrel 2, diametrically opposite the first aperture 2*b*, is a second or charging aperture 2*c*. The first and second apertures are in alignment. A rocking lever 7 is pivotally mounted on a bearing bolt 8, within a slot-shaped recess 2*d* in the barrel 2. Rocking lever 7 is a two-arm member with one arm forming a stop 7*a* at the end of the arm. A second arm of the rocking lever 7 forms a support shoulder 7*b*, which cooperates with an abutment 2*e*, on the barrel 2 with the abutment formed as a lug. A spring 9, constructed as a torsion spring, holds the rocking lever 7 in the position shown in FIG. 1 with the stop 7*a* located within the second aperture 2*c*, so that the surface of the stop is aligned with the surface of the barrel bore 2*a* or, in other words, forms a continuation of the barrel bore surface.

In FIG. 1, a nail strip 11 is shown inserted into the magazine 4. Nail strip 11 is made up of individual holders or guide bushings 11*a*, connected together by separable webs 11*b*. A nail 11*c* is held in each of the guide bushings 11*a*. Nail strip 11 is guided within the magazine 4 so that it is displaced in its long direction toward the barrel bore by the slide 5 whereby the nail strip is pressed against the stop 7*a*, as shown by the arrow in FIG. 1. Accordingly, a nail 11*c* is held in the barrel bore in alignment with the driving piston, that is, it is axially aligned with the barrel bore and the piston.

When an explosive powder charge in the setting device is ignited, the driving piston 3 is propelled against the nail 11c held in the barrel bore 2*a*, and the nail is driven through the muzzle of the barrel 2, into a receiving material after the guide bushing 11*a*, holding the nail, is separated from the remaining portion of the nail strip extending into the magazine. After the driving piston 3 has returned into the position shown in FIG. 1, the spring biased slide 5 presses the remaining nail strip 11 into contact with the stop 7*a* with the setting device being ready to insert the next nail in the strip.

Figure 2:
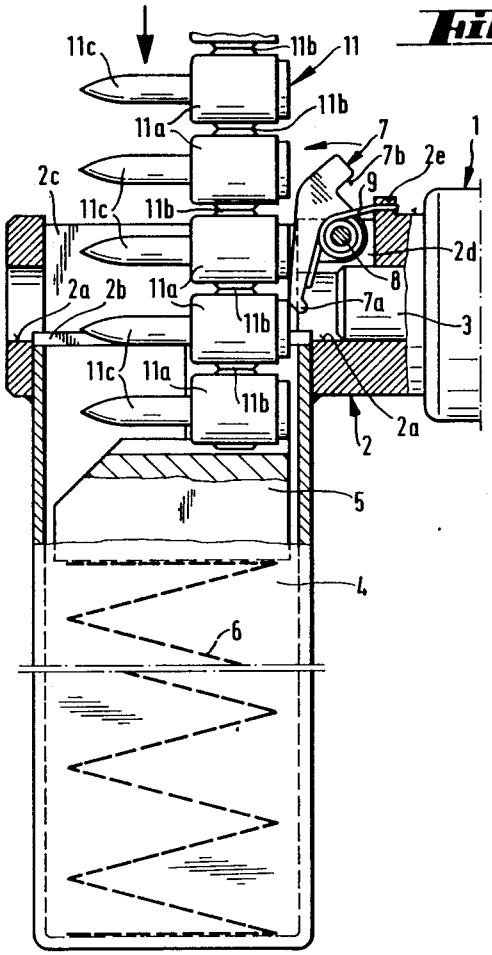
FIG. 2 is a partial view of the setting device as shown in FIG. 1, with a nail strip partially inserted into the magazine.

In FIG. 2, the step of inserting or introducing a nail strip 11 through the second or charging aperture 2*c*, into the setting device, is displayed, as indicated by the arrow showing the direction of movement of the strip into the magazine 4. For this step, the rocking lever 7 is pivotally displaced against the force of the spring 9, note the rotary arrow, with the stop 7*a* being moved counter-clockwise as viewed in FIG. 2, out of the second aperture 2*c*. The end of the nail strip 11, leading in the direction of movement into the magazine, contacts the slide 5 and moves it against the force of the spring 6 into the position shown in FIG. 1. As soon as the opposite end of the nail strip moves into the barrel, past the stop 7*a*, the rocking lever 7 is pivoted about the bearing bolt or pin 8 by the spring 9 and returns into the position shown in FIG. 1 with the stop 7*a* located in the second aperture 2*c* and its shoulder 7*b* bearing against the abutment 2*e*.

It is possible to remove a nail strip 11 from the setting device by displacing the rocking lever 7 into the position as shown in FIG. 2, so that the strip is biased by the spring 6 and the slide 5 out of the magazine.

While specific embodiments of the invention have been shown and described in detail to illustrate the application of the inventive principles, it will be understood that the invention may be embodied otherwise without departing from such principles.

We claim:

1. Explosive power charge operated setting device comprising an axially extending barrel forming a barrel bore having a bore surface, said barrel having a first aperture opening into the barrel bore, an elongated guide magazine having a first end positioned at said first aperture and arranged to receive a nail strip therein, string means within said magazine for biasing the nail strip toward the barrel bore, wherein the improvement comprises a second aperture in said barrel diametrically opposite and aligned with said first aperture, a stop displaceably mounted on said barrel and having a first position with said stop positioned in the second aperture and aligned with the bore surface for stopping a nail in the strip in alignment with the axis of the barrel bore, an abutment is formed on said barrel for supporting said stop in the first position, said stop is part of a rocking lever pivotally supported on said barrel, and said rocking lever comprises two arms each extending oppositely from a pivot pin for the rocking lever, with one arm forming said stop and the other arm forming a support shoulder for contacting said abutment.

2. Explosive powder charge operated setting device, as set forth in claim 1, wherein a spring mounted on said barrel contacts said rocking lever and biases said stop into the first position.

3. Explosive powder charge operated setting device, as set forth in claim 2, wherein said rocking lever is pivotally displaceable about said pivot pin into a second position displaced out of said second aperture.

* * * * *